US009255698B2

(12) United States Patent
Scordino et al.

(10) Patent No.: US 9,255,698 B2
(45) Date of Patent: Feb. 9, 2016

(54) MOUNTING DEVICE FOR LIGHTING SOURCES

(71) Applicant: OSRAM AG, Munich (DE)

(72) Inventors: Alessandro Scordino, Dolo (IT); Marco Lamonato, Crocetta del Montello (IT); Simon Bobbo, Chirignago (IT); Alberto Alfier, Vedelago (IT)

(73) Assignee: OSRAM GmbH, Munich (DE)

( * ) Notice: Subject to any disclaimer, the term of this patent is extended or adjusted under 35 U.S.C. 154(b) by 30 days.

(21) Appl. No.: 13/650,172

(22) Filed: Oct. 12, 2012

(65) Prior Publication Data

US 2013/0094227 A1 Apr. 18, 2013

(30) Foreign Application Priority Data

Oct. 13, 2011 (IT) ..... TO2011A0917

(51) Int. Cl.

| | |
|---|---|
| ***F21V 29/00*** | (2015.01) |
| ***F21V 19/00*** | (2006.01) |
| ***F21V 29/76*** | (2015.01) |
| *F21V 19/04* | (2006.01) |
| *F21Y 101/02* | (2006.01) |

(52) U.S. Cl.

CPC ..... *F21V 19/0055* (2013.01); *F21V 19/005* (2013.01); *F21V 29/76* (2015.01); *F21V 19/04* (2013.01); *F21V 29/004* (2013.01); *F21Y 2101/02* (2013.01)

(58) Field of Classification Search

CPC .. F21V 29/004; F21V 19/005; F21V 19/0055

USPC ..... 362/382

See application file for complete search history.

(56) References Cited

U.S. PATENT DOCUMENTS

| | | | | |
|---|---|---|---|---|
| 6,786,691 | B2 * | 9/2004 | Alden, III | 411/371.2 |
| 7,790,511 | B2 * | 9/2010 | Chainer | 438/122 |
| 7,828,465 | B2 * | 11/2010 | Roberge et al. | 362/294 |
| 7,988,336 | B1 * | 8/2011 | Harbers et al. | 362/294 |
| 2004/0247386 | A1 * | 12/2004 | Sugiyama et al. | 403/408.1 |
| 2007/0171667 | A1 | 7/2007 | Watanabe et al. | |
| 2008/0050196 | A1 * | 2/2008 | Cao et al. | 411/107 |
| 2008/0144320 | A1 | 6/2008 | Tokunaga | |
| 2008/0224166 | A1 | 9/2008 | Glovatsky et al. | |
| 2010/0046232 | A1 | 2/2010 | Matsui et al. | |
| 2011/0069502 | A1 | 3/2011 | Hum | |
| 2011/0123291 | A1 * | 5/2011 | Chiu | 411/342 |
| 2011/0194285 | A1 | 8/2011 | Harbers et al. | |
| 2011/0215700 | A1 * | 9/2011 | Tong et al. | 313/46 |
| 2011/0234940 | A1 * | 9/2011 | Ishinagawa | 349/62 |

* cited by examiner

*Primary Examiner* — Evan Dzierzynski

(74) *Attorney, Agent, or Firm* — Viering, Jentschura & Partner

(57) ABSTRACT

A device for mounting planar lighting sources having a light emitting surface on a substrate includes a frame provided with fixing formations for fixing the frame on the substrate with the planar lighting source sandwiched between the frame and the substrate. The frame has an opening to surround the light emitting surface of said lighting source and is provided with elastic formations to elastically urge the lighting source toward the substrate. The fixing formations include at least one resilient formation to resiliently urge the frame toward the substrate.

8 Claims, 2 Drawing Sheets

MOUNTING DEVICE FOR LIGHTING SOURCES

CROSS REFERENCE TO RELATED APPLICATION

This application claims priority to Italian Patent Application No. TO2011A000917, which was filed Oct. 13, 2011 and is incorporated herein by reference in its entirety.

TECHNICAL FIELD

Various embodiments relate to the mounting of lighting sources on substrates. More particularly, various embodiments may relate to the mounting of lighting sources, for example LED or planar lighting sources, on a substrate constituted, for example, by a heat sink and/or by the body of a lighting device ("luminaire").

BACKGROUND

For mounting lighting sources on a substrate, it is possible to use screws.

This solution ensures mechanical contact, but may give rise to disadvantages associated with the fact that the mechanical contact does not allow uniform distribution of the pressure, and therefore the thermal interface properties and the heat transfer may not be uniform on the contact surface and may deteriorate over time.

SUMMARY

Various embodiments disclose systems for mounting a lighting source (light engine) on a substrate, serving for example as a body of a lighting device and/or as a heat sink, by means of a retention system such that one or more of the following advantages are provided:

optimum mechanical contact between the lighting source and the surface of the substrate (lighting device and/or heat sink);

easy and quick process for mounting the lighting source on the substrate;

standard mounting structure (thermal) is stable and reliable;

the possibility to implement arrays of lighting modules; and the ability to efficiently absorb the tolerances between the parts which are assembled.

According to aspects of this disclosure, a device is provided having the features specifically mentioned in the claims which follow.

The claims form an integral part of the technical teaching provided here in relation to the invention.

Various embodiments make it possible to achieve one or more of the following advantages:

simple and economical configuration in order to couple a lighting source to a substrate, such as a heat sink;

the possibility for the fitter to choose whether to possibly use a lighting module with dimensions which are also not closely linked to the characteristics of the retention device;

the possibility to absorb the expansion and contraction phenomena derived from the heat cycles to which the lighting source is subjected during operation;

uniform distribution of the pressure on the contact surface between the lighting source and the substrate (for example a heat sink, with the possibility to achieve an optimum thermal connection);

the possibility to regulate the pressure exerted on the lighting source, for example depending on the thermal requirements, by means of the regulation/selection of elastic members.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

In the following description, various specific details aimed at providing a fuller understanding of the embodiments are explained. The embodiments may be implemented without one or more of the specific details or using other methods, components, materials, etc. In other cases, known structures, materials or operations are not shown or described in detail so that various aspects of the embodiment may be understood more clearly.

The reference to "an embodiment" in the context of this description indicates that a particular configuration, structure or feature described in relation to the embodiment is included in at least one embodiment. Therefore, phrases such as "in one embodiment", which may occur at various points in this description, do not necessarily refer to the same embodiment. Moreover, particular forms, structures or features may be combined in any suitable manner in one or more embodiments.

The most common reference signs are provided solely for the sake of convenience and therefore do not define the scope of protection or ambit of the embodiments.

In the figures, a device which allows a lighting source 12 to be mounted on a substrate S is denoted as a whole by 10.

Figure 1:
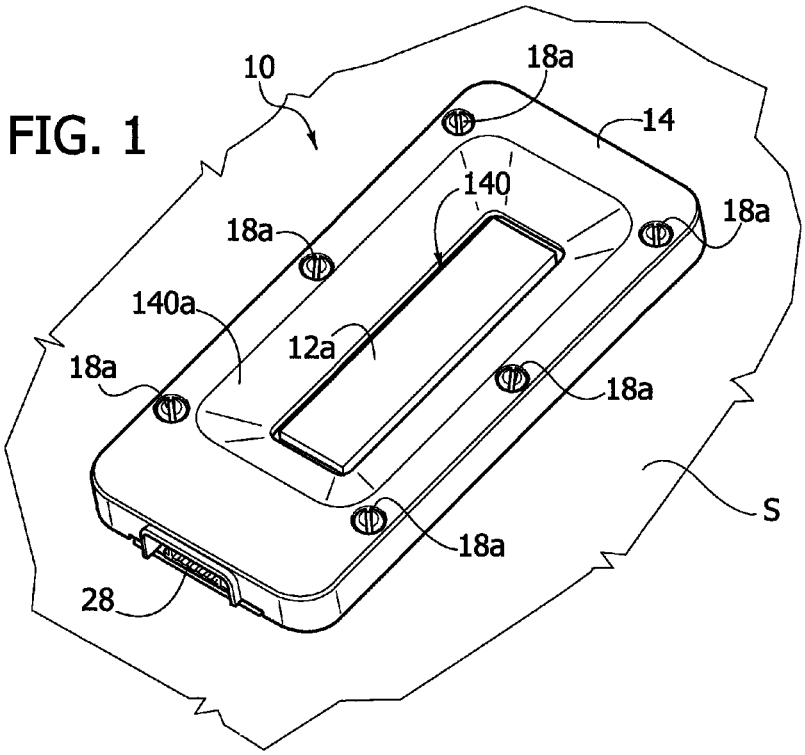
FIG. 1 is a general perspective view of one embodiment.
Figure 2:
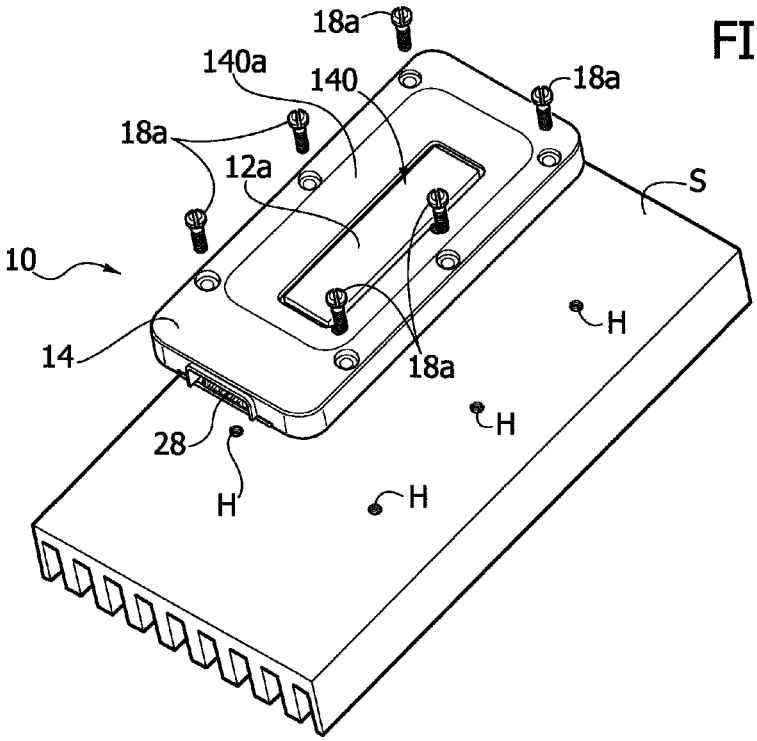
FIG. 2 shows an embodiment in a partially exploded configuration.
Figure 3:
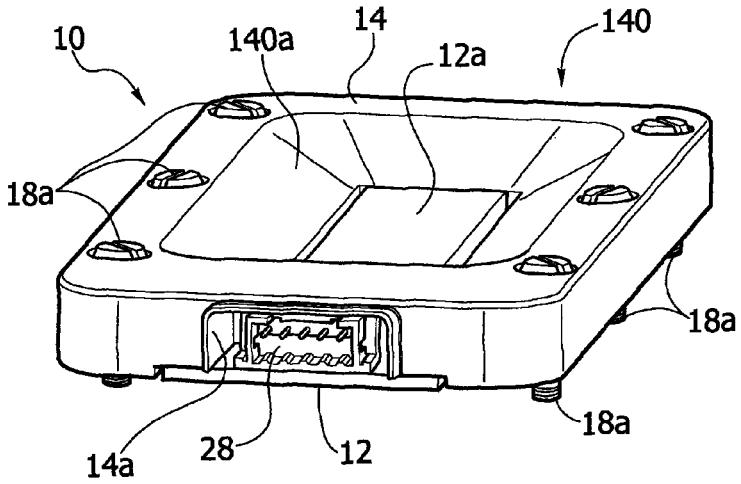
FIG. 3 is a perspective view of an embodiment.

In various embodiments, the substrate S may be constituted, for example, by a heat sink (such as that shown in FIG. 2) or, in general, by a support for a lighting device of which the lighting source 12 constitutes the active member.

In various embodiments, the lighting source 12 has a planar general shape and is thus like a board or card (for example a printed circuit board—PCB—for example with a rectangular shape) including an active LED module 12*a* which defines the light emitting surface of said lighting source 12.

Lighting sources of this type ("light engine") are known in the art, for example in the solution known as Chip-on-Board (CoB).

In various embodiments, the device 10 may include a frame 14, for example made of plastic material or metallic material, for example with good heat dissipation properties, implemented in such a way as to make it possible to mount the lighting source 12 by sandwiching it between the frame 14 and the substrate S.

Figure 5:
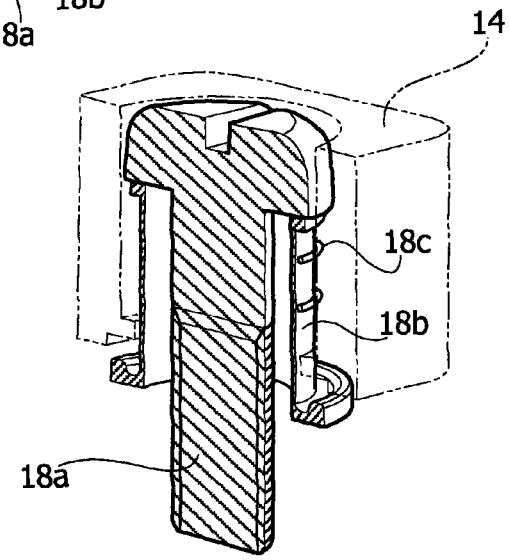
FIG. 5 shows, in a magnified view, a detail of embodiments.

In various embodiments, the frame 14 may be fixed on the substrate S by means of fixing formations which, in various embodiments, may include (see in particular FIG. 5): a screw or rivet 18*a* capable of extending from the frame 14 to engage a corresponding opening H (for example a threaded hole) provided on the surface of the substrate S, and a bushing 18*b* fitted on the screw or rivet 18*a* and acting as a guide member for a resilient member 18*c*, which can be constituted, in various embodiments, by a helical spring fitted around the bushing 18*b*.

Whichever the specific embodiment adopted (for example, the spring 18*c* could be fitted directly on the screw or rivet 18*a*, or could be substituted by an equivalent resilient member, such as an elastic sleeve), the fixing formations described make it possible for the frame 14 to be mounted on the substrate S with the possibility to regulate the force with which the frame 14 is urged toward said substrate S, thus the force with which the frame 14 urges the lighting source 12 sandwiched between the frame 14 and the substrate S against the substrate S.

This result can be obtained by regulating and/or appropriately selecting the features of resilience of the resilient member, such as the spring 18*c*.

In various embodiments, it is moreover possible to select the thickness or height of the frame 14 such that, when it is fixed on the substrate S, the frame 14 remains at a distance from the surface of the substrate S, so that it does not make contact with the surface of the substrate S.

This solution is advantageous for achieving uniform distribution of the force exerted (according to the methods described in more detail hereinbelow) on the lighting source 12 to make it rest on the substrate S.

Figure 4:
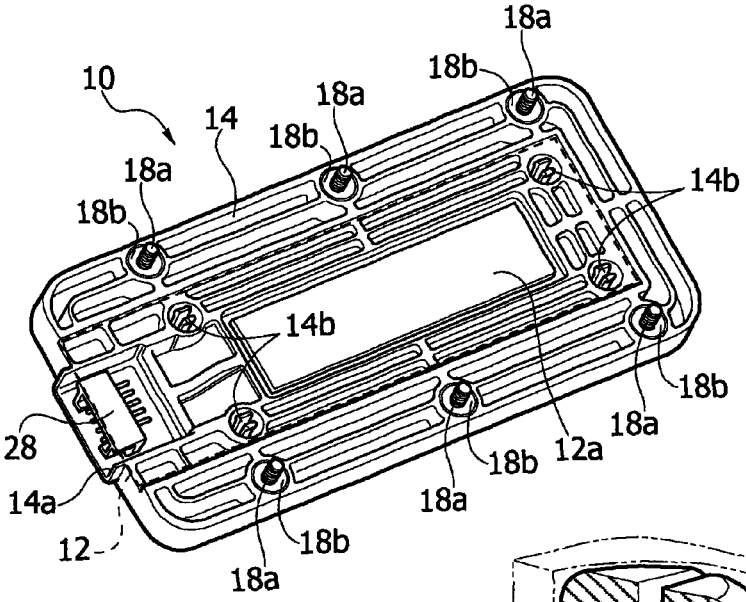
FIG. 4 is a perspective view of an embodiment.

As can be seen more clearly in the view in FIG. 4 (which corresponds substantially to a view of the frame 14 observed "from underneath"), in various embodiments the surface or face of the frame 14 intended to be turned toward the lighting source 12, thus toward the substrate S, may have at least one of the following features: the aforementioned surface is provided with elastic pins 14*b* (returned or formed as one piece, for example in the case in which the frame 14 is made of molded material) which constitute elastic formations able to urge the lighting source 12 toward the substrate S, resting on said substrate, and/or the aforementioned surface of the frame 14 has in general a ribbed or finned aspect so as to promote the heat dissipation effect for the heat generated by the lighting source 12 during operation thereof.

In various embodiments, the lighting source 12 may be provided with a connector 28 for the electrical connection (power supply and possibly control and detection signals) of the lighting source 12. The frame 14 may then have a window 14*a* such that, with the frame 14 fixed on the substrate S, the connector 28 is left exposed so as to allow the connection thereof to a power supply/control line of the lighting source 12 (not explicitly shown in the drawings).

In various embodiments, the frame 14 has an opening 140 which, in a manner of speaking, surrounds or borders the active portion 12*a* of the lighting source 12. In various embodiments, the opening 140 may be delimited by a divergent wall 140*a* which opens up like the tiers of a stadium from the lying position intended to be taken by the light emitting surface 12*a* of the lighting source 12.

In various embodiments, the frame 14 may possibly be provided with spring-like fins intended to cooperate with the periphery of the lighting source 12 so as to retain the lighting source 12 on the frame 14 even when it has not (yet) been fixed on the substrate S.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A device for mounting planar lighting sources having a light emitting surface on a substrate, the device comprising:

a frame provided with fixing formations for fixing said frame on said substrate with the planar lighting source sandwiched between the frame and the substrate, wherein: said frame has an opening to surround the light emitting surface of said lighting source, said frame is provided with elastic formations to elastically urge said lighting source toward said substrate, and said fixing formations include at least one resilient formation to resiliently urge said frame toward said substrate.

2. The device as claimed in claim 1, wherein said resilient formation is a spring.

3. The device as claimed in claim 1, wherein said fixing formations include rivets or screws which extend between said frame and said substrate.

4. The device as claimed in claim 1, wherein said lighting source has a connector to provide electrical contact to said lighting source, and wherein said frame has a window leaving said connector exposed when said frame is fixed on said substrate.

5. The device as claimed in claim 1, wherein said frame has a finned surface to face said substrate.

6. The device as claimed in claim 1, wherein said opening in the frame opens is at an angle from the light emitting surface of said lighting source.

7. The device as claimed in claim 1, wherein said frame has a thickness whereby said frame does not contact said substrate.

8. The device as claimed in claim 1, wherein said substrate is a heat sink.

* * * * *